United States Patent [19]

Gorman et al.

[11] 4,404,784

[45] Sep. 20, 1983

[54] ANTISIPHON LAP JOINT FOR BUILDING SHEETS

[75] Inventors: Kenneth G. Gorman, Dallas; Richard A. Marx, Salem, both of Oreg.

[73] Assignee: Valley Rolling Mills, Inc., Salem, Oreg.

[21] Appl. No.: 320,186

[22] Filed: Nov. 12, 1981

[51] Int. Cl.[3] ..... E04D 1/34; E04D 3/30

[52] U.S. Cl. ..... 52/534; 52/521; 52/537

[58] Field of Search ..... 52/534, 537, 521

[56] References Cited

U.S. PATENT DOCUMENTS

| | | | |
|---|---|---|---|
| 309,134 | 12/1884 | Cooper | 52/536 |
| 917,213 | 4/1909 | Welch | 52/534 |
| 1,072,508 | 9/1913 | Roth . | |
| 1,251,310 | 12/1917 | Welch | 52/534 |
| 1,444,170 | 2/1923 | Daut . | |
| 1,889,784 | 12/1932 | Harter . | |
| 2,153,119 | 4/1939 | Kahn et al. . | |
| 2,163,840 | 6/1939 | Hunker | 52/534 |
| 2,199,924 | 5/1940 | Randolph . | |
| 3,041,784 | 7/1962 | Facer et al. | 52/537 X |
| 3,150,465 | 9/1964 | Johnson | 52/537 |
| 3,481,094 | 12/1969 | Taylor | 52/394 |
| 3,520,100 | 7/1970 | Webb | 52/534 |
| 3,906,696 | 9/1975 | Poter et al. | 52/536 |
| 3,990,206 | 11/1976 | Reusser | 52/534 |

FOREIGN PATENT DOCUMENTS

| | | | |
|---|---|---|---|
| 219634 | 10/1924 | United Kingdom | 52/537 |

OTHER PUBLICATIONS

Max-Rib, McElroy Metal Mill, Clinton, Ill., 61727, 2 pages.

*Primary Examiner*—Alfred C. Perham

*Attorney, Agent, or Firm*—Chernoff, Vilhauer, McClung, Birdwell & Stenzel

[57] ABSTRACT

A building sheet suitable for roofing and siding provides a weatherproof lap joint having an antisiphon gap when installed partially overlapping an adjacent like building sheet by spacing the entire overlapping portion of one sheet above the lapped portion of an adjacent sheet. Parallel strengthening ribs formed into the building sheet are structurally modified along one edge to form an overlapping member and along the opposite edge to form a lapped member. The overlapping member includes an intermediate strengthening bead and an exterior downwardly projecting sealing lip which rests upon the lapped member of an adjacent sheet and spaces the entire overlapping member of one sheet above the lapped member of the adjacent sheet. The force created by fasteners securing the flat portions of the sheets to the underlying structure is transferred through the overlapping member, due to its being entirely separated from the lapped member, and focuses downward pressure at the sealing lip causing it to resiliently deform and achieve a tight seal while maintaining the antisiphon gap. Low sills, alternating in a parallel array with the ribs, add strength to the sheet, as does the bead incorporated into the margin of the overlapping member and a small angled fastening flange along the edge of the lapped member which also provide additional rigidity to these edges.

12 Claims, 4 Drawing Figures

ANTISIPHON LAP JOINT FOR BUILDING SHEETS

BACKGROUND OF THE INVENTION

This invention relates to building sheets suitable for roofing and siding of buildings, and particularly to improvements in design of the overlapping portions of such building sheets.

Overlapping the flat planar edges of adjacent building sheets may form a tight seal, but the contiguous flat surfaces would encourage capillary attraction when the outside surface became wet, thereby passing the water through the joint to the inside surface. Typically, prior art lap joint constructions for such building sheets discourage capillary attraction at the overlap by spacing a portion of the overlapping sheet away from the lapped sheet to create an antisiphon gap. This widely-used technique is shown in U.S. Letters Patent Nos. 1,072,508, 1,444,170, 1,889,784, 2,153,119, 2,199,924, 3,481,094, 3,520,100, 3,906,696, and 3,990,206. Because such building sheets are typically formed with parallel ribs or corrugations to increase their strength and encourage draining, the structural components to form the antisiphon gap are usually incorporated into the ribbed or corrugated pattern.

Many of these lap joint constructions such as those taught in U.S. Letters Patent Nos. 1,072,508, 2,153,119, and 3,481,094 employ a complex design and consequently use a greater quantity of material to achieve the antisiphon lap than would a simple design. Since most of these building sheets are manufactured by rolling sheet steel through dies which form the sheet into the typically ribbed or corrugated patterns, a complex rib design not only uses more of the width of the original sheet of steel than a simpler rib design would, but also requires more elaborate dies and slower rolling speed. However, the complex lap designs do have the advantage of adding strength to the edges which discourages deformation during handling, transport and installation.

Several techniques of sealing the overlap are disclosed by the above-listed prior art patents. The simplest technique is embodied in U.S. Letters Patent Nos. 3,520,100 and 1,889,784 where the seal is achieved by having the shape of the overlapping portion generally conform to the shape of the lapped portion except for the provision of an antisiphon gap. This group of art does not disclose the use of a fastener to enhance or achieve this seal.

A widely used technique discloses the use of a fastener through the raised rib to achieve a positive seal by forcing the contiguous surfaces of the lap joint together or by concentrating pressure at one or more points within the lap joint as disclosed in U.S. Letters Patent Nos. 1,444,170, 1,072,508, 2,153,119, 2,199,924, and 3,990,206. This technique, while effective to achieve a positive seal, has several problems associated with it. Use of a sealing washer or packing is necessary to assure that water does not enter into the antisiphon lap joint from around the fastener. The fastener therefore must be emplaced with sufficient force to compress a rubber or neoprene washer customarily used to form a watertight seal around the fastener. Fastening through the raised rib of the lap joint with sufficient force to compress the washer can distort the rib by either denting or battering. This distortion can effect the seal between the lapped and overlapping portions or interfere with the antisiphon gap. Of course, the rib or raised portion of the lap joint may be strengthened by employing a more complex cross-sectional design or by using heavier gauge material in the building sheet, but these solutions increase the manufacturing costs. Since these building sheets are customarily made of steel or other metal, another problem with this method of sealing relates to the relative movement of the metal resulting from various causes. When the fastener is emplaced through the rib rather than flush on the major planar surface of the sheet, the effect of the metal expanding and contracting due to changes in temperature is magnified by the lever arm provided by the unsupported shaft of the fastener. This movement as well as other movements of the sheeting due to wind, weather, settling of the underlying structure, and the like are more likely to gradually loosen a fastener placed through a rib than one which is snugly emplaced through a planar portion of the sheet with no exposed shaft.

A third type of seal disclosed in U.S. Letters Patent No. 3,990,206 avoids the above-mentioned problems associated with fastening through the rib by placing the fastener off the rib but still using the force of the fastener to enhance the seal. This is accomplished by configuring the overlapping portion so that the extreme edge would project below the plane of the building sheet and is resiliently distorted by the force of the fastener to sit flush on the plane of the underlying sheet. However, a large percentage of the overlapping portion remains in contact with the lapped portion and because of this large area of mutual contact present in this lap joint, the force of the fastener is somewhat distributed and not focused at the sealing edge.

SUMMARY OF THE INVENTION

The present invention provides a building sheet adapted to form a lap joint with other sheets of like form having opposed lapped and overlapping margins which are adapted to overlap in a spaced relationship wherein they are spaced apart by a downwardly-projecting sealing lip formed exterior of a strengthening bead which extends along the margin of the overlapping sheet. The sealing lip is resiliently pressed down by the force of a fastener placed through the overlapping sheet and off the raised rib. The force is transmitted through the overlapping portion to cause the edge of the sealing lip to be tightly forced against the sloping wall of the rib which forms the lapped edge. This focusing of the force of the fastener along the edge of the sealing lip is possible because the entire overlapping member is held above the lapped member and there are no large areas of mutual contact to distribute the force of the fastener. In addition, the fact that the sealing lip causes the entire overlapping member to be spaced above the lapped member creates the antisiphon lap.

According to a preferred embodiment of the invention, a generally planar building sheet is provided with a first margin adapted to be lapped, or lapped member, and a parallel laterally-opposed second margin adapted to overlap, or overlapping member. A series of uniform, spacedapart, strengthening ribs and sills, separated by flat planar panels, are arranged across the width of the sheet, parallel to the lapped and overlapping margins. One of these basic ribs is incorporated into the structure of each lapped and overlapping member. The structure of each rib and sill includes a pair of upwardly-converging sloping side walls connected by a flat top portion or "table."

The lapped member is formed by a basic rib which has an integrally-formed relatively narrow exterior fastening flange extending upwardly from the plane of the sheet and outwardly from the basic rib along the base thereof.

The overlapping member is formed by a portion of the basic rib with an exterior sealing lip extending along the length thereof. The sealing lip is attached to the portion of the basic rib by an intermediate, parallel extending strengthening bead. The sealing lip projects downwardly toward the plane of the building sheet, and outwardly from the basic rib.

The sheets are arranged so that the overlapping member of one sheet overlies the lapped member of the adjacent sheet and is held in spaced relation above the lapped member by the downwardly projecting sealing lip which rests near the midpoint of the supporting sidewall of the basic rib which forms the lapped member. A fastener is placed through the overlapping sheet and into the underlying structure in such a location and with sufficient force to flatten the fastening flange between the overlapping sheet and the underlying structure, thereby forming a tight seal which blocks even the passage of reflected light from outside the structure. Tightening the fastener also forces the sealing lip down upon the sloping side wall of the basic rib which forms the lapped member. The force of the fastener which is transferred to the edge of the sealing lip acts cooperatively with the angle at which the sealing lip contacts the supporting sloping side wall to encourage the sealing lip to resiliently deform, sliding slightly down the slopping side wall, to achieve a tight even seal. In this way, the slight distortion of the sealing lip exterior of the strengthening bead corrects small irregularities occurring in the sealing lip, either caused by handling or present in the original flat building sheet material, enabling the edge of the lip to evenly contact the supporting side wall. This slight resilient distortion of the sealing lip is not sufficient to bring the overlapping member into close mutual contact with the lapped member, thereby maintaining the antisiphon gap and preventing capillary attraction between the overlapping sheets.

Accordingly, it is a principal objective of the present invention to provide an improved lap joint for building sheets which will form a tight weatherproof seal and discourage capillary attraction.

It is another object of the present invention to provide a building sheet adapted to overlap like building sheets in spaced relationship to discourage capillary action through the joint between them while achieving a tight seal at both edges of the overlap.

It is a further object of the present invention to provide such a building sheet that will resist gross deformation during handling and installation.

It is a further object of the present invention to provide such a building sheet that when installed overlapping a like sheet will form a tight seal at both ends of the overlap, correcting slight irregularities either due to handling or present in the original flat building sheet material.

It is a further object of the present invention to provide such a building sheet that uses a minimum amount of raw materials and an economical manufacturing process.

It is a further object of the present invention to provide such a building sheet that will nest or stack well to be economically transported without damage.

It is a further object of the present invention to provide a lap joint for building sheets which achieves a positive point seal by placing the fastener off the raised rib.

It is a further object of the present invention to provide a lap joint for building sheets which focuses the force, caused by a remote fastener, at a point seal by spacing the entire overlapping member above the lapped member.

It is an associated object of the present invention to provide a lap joint for building sheets which will discourage the entry of water and windblown particles into the lap joint and will encourage the removal of any water or particles that enter therein.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figures 1, 2, 3, 4:
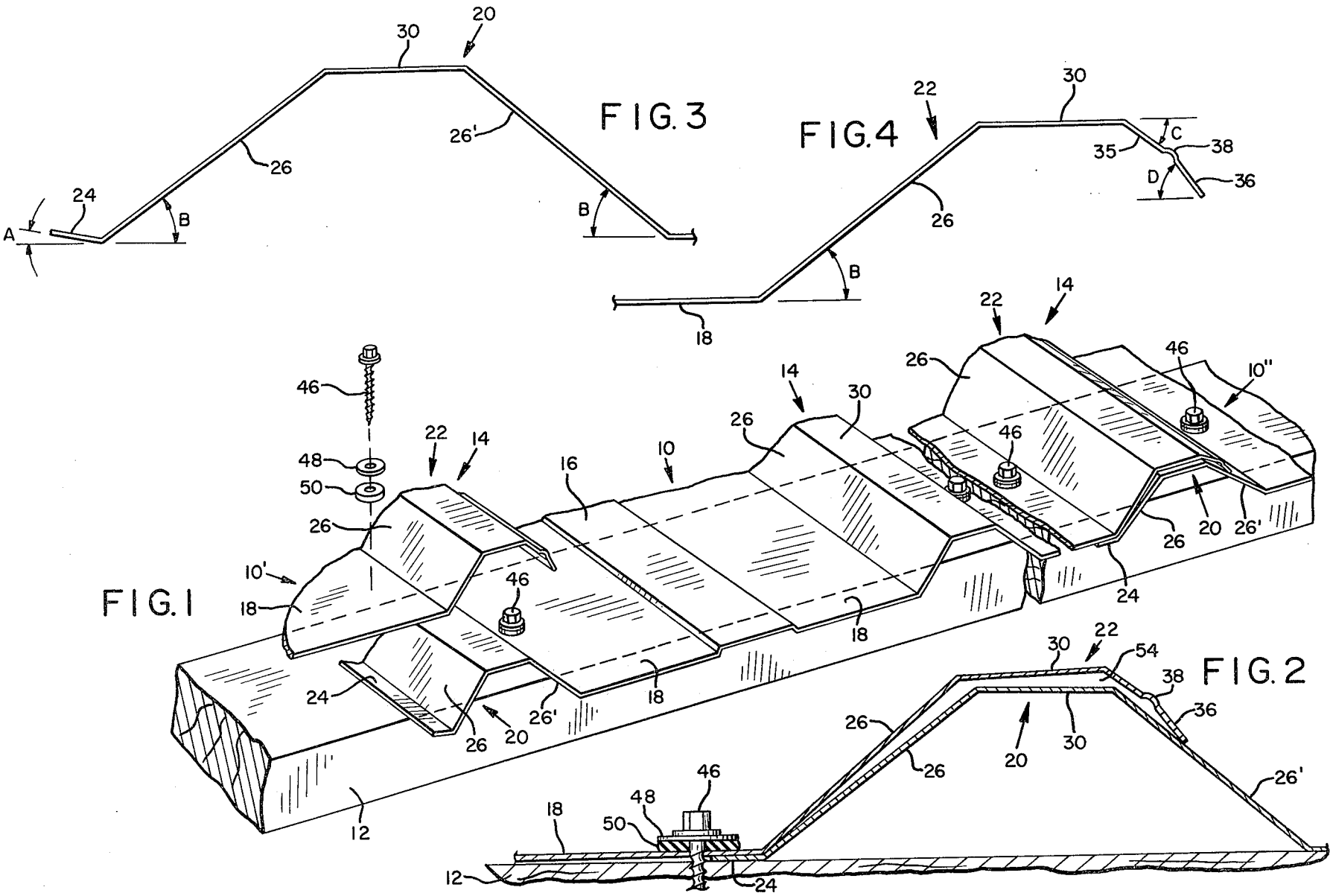
FIG. 1 is a fragmentary, foreshortened perspective view of overlapping building sheets embodying the antisiphon lap joint of the present invention.
FIG. 2 is a fragmentary sectional end elevational view showing the details of the antisiphon lap joint.
FIG. 3 is a fragmentary end elevational view of the margin of the sheet adapted to be the lapped member.
FIG. 4 is a fragmentary end elevational view of the margin of the sheet adapted to be the overlapping member.

Referring to FIGS. 1 through 4 of the drawings, an exemplary embodiment of the invention includes a building sheet 10, preferably rolled or stamped from a single sheet, such as is partially shown in FIG. 1 attached to a wooden frame member such as a nailer 12. A like building sheet 10' is partially shown overlapping, in exploded view, one edge of the building sheet 10, while a second like building sheet 10'' is partially shown being overlapped by the laterally opposed edge of the building sheet 10. In such a way, the building sheets overlap like adjacent building sheets to cover a large area such as a sloping roof.

The building sheets 10, 10' and 10'' are all comprised of a parallel array of alternating basic ribs 14 and sills 16 separated by planar panels 18, all extending the length of the sheet 10, parallel to its edges. Each basic rib is formed by a pair of upwardly-converging sloping side walls 26 which are interconnected at their upper edges by a flat portion or table 30. The basic ribs 14 and the sills 16 are integrally formed in the sheet 10 and provide sectional strength and rigidity to the building sheet 10 while the planar panels 18 act as a trough between the raised basic ribs 14 and the sills 16 to channel draining water. The basic ribs 14, which are formed in the margin portions of the sheet adapted to lap, are specially constructed to facilitate the overlap.

Each building sheet 10 has a lapped member 20, shown in FIG. 3, located along one margin and an overlapping member, 22 shown in FIG. 4, located along the laterally opposed margin. The basic structural feature of both the lapped member 20 and the overlapping member 22 is the basic rib 14 which is present at spaced intervals across the width of the building sheet 10.

The lapped member 20, as illustrated in FIG. 3, is comprised of a basic rib 14 with the addition of an exterior fastening flange 24. The fastening flange 24 projects outwardly from the sheet 10 at the base of the exterior sloping side wall 26 and upwardly from the plane of the sheet 10 and extends throughout the length of the sheet 10. The fastening flange angle A, which is the acute angle formed between the fastening flange 24 and the plane of the sheet is preferably less than the rib angle B, which is the acute angle formed between the side walls 10 and the plane of the sheet. In this exemplary embodiment, the rib angle B is 36° 40' and the fastening flange angle A is 10°.

The overlapping member 22 shown in FIG. 4 includes an inner portion of the basic rib 14, incorporating the inner sloping side wall 26, which faces toward the building sheet 10, the table 30, and an upper portion 35 of the outer sloping side wall, which faces away from the building sheet 10, as shown in FIG. 4. A sealing lip 36, projects downwardly and outwardly from the edge of the foreshortened outer sloping side wall and extends the length of the sheet parallel to the rib 14. The sealing lip 36 is interconnected to the rest of the overlapping member by an intermediate strengthening bead 38. The strengthening bead 38 is C-shaped as seen from an end of the sheet 10 and projects above the juncture of the upper portion 35 of the outer sloping side wall and the outer sealing lip 36 a distance approximately equal to the thickness of the building sheet. The outer sealing lip 36 is inclined downwardly from the plane of the table 30 at a slightly steeper slope than the upper portion 35 of the outer sloping side wall. In the exemplary embodiment of the invention shown in FIGS. 1 through 4 the rib angle B formed by the plane of the sheet 10 and the sloping side walls 26 is 36° 40'. Since the plane of the table is parallel to the plane of the sheet, the table angle C, the acute angle formed by the upper portion 35 of the outer sloping side wall and the plane of the table 30 is also 36° 40'. The sealing lip angle D formed by imaginary extensions of the sealing lip 36 with the plane of the building sheet 10 or the table 30 is preferably 46° 40', or 10° greater than the table angle C or rib angle B.

The shape of the building sheet 10 as shown in FIG. 1 and partially detailed in FIGS. 3 and 4 is preferably achieved by forming a flat sheet which typically has already been treated with a protective coating. The relatively simple design of the present invention uses less width of the original flat sheet to form the ribs 14 and the sills 16 than would a more complex lap joint construction. Since these sheets are typically formed by rolling the flat sheet through dies, the simple structural design also requires less complex dies and may be formed at a higher rolling speed, all contributing to economy of manufacture. Locating the strengthening bead 38 proximate the edge of the overlapping member 22, and the angled fastening flange 24 proximate the edge of the lapped member 20 provides extra strength and rigidity to the edges of the sheet which are most vulnerable to damage and distortion during handling, transport and installation.

The sill 16 as shown in FIG. 1 has relatively short upwardly-converging side walls and a relatively broad flat top portion. The broad flat top portion of the sill 16 is in a plane which is parallel to the plane of the building sheet 10. The sloping side walls of the sill are at the same acute angle with respect to the plane of the sheet 10 as are the sloping side walls 26 of the ribs 14. The sills provide additional section strength and rigidity to the sheet and help channel the draining water onto the planar panels 18. In the exemplary embodiment of the building sheet 10 partially shown in FIG. 1, the building sheet 10 is comprised of five basic ribs 14, including a lapped member 20 and overlapping member 22 alternated with four sills 16, each separated from each other by one of eight planar panels, all integrally formed in the sheet and all arranged parallel.

In use as shown in FIG. 2, the lap joint is configured by an overlapping member 22 of one sheet 10 being positioned above a lapped member 20 of an adjacent sheet 10 so that the base of the exterior sloping side wall 26 of the lapped member 20 is directly beneath the base of the inner sloping side wall 26 of the overlapping member 22. In this position the downwardly-projecting outer sealing lip 36 contacts the interior sloping side wall 26' of the lapped member 20 and holds the entire overlapping member 22 above the lapped member 20, preventing close mutual surface contact between the lapped and overlapping members 20 and 22 and thereby creating an "antisiphon" gap 54. Not only is the table 30 of the overlapping member 22 held above the table 30 of the lapped member 20, but so too is the inner sloping side wall 26 of the overlapping member 22 held above the exterior sloping side wall 26 of the lapped member 20.

The building sheets are affixed to the underlying structure by fasteners 46 placed through the planar panels 18 proximate the ribs 14 into a typically wooden frame member such as a nailer 12 which extends transversely beneath the sheet, normal to the alignment of the ribs 14 as shown in FIG. 1. The building sheet 10, where it lies upon the nailer 12, is supported by the planar panels 18 which lie flush on the nailer 12.

The fastener 46, shown in exploded configuration in FIG. 1, typically comprising a screw with an integral collar between the shaft and the head, is used in conjunction with a metal washer 48, and a rubber or neoprene sealing washer 50 and is placed through the planar panel 18 proximate the overlapping member 22 so that the shaft of the fastener 46 is immediately adjacent to the edge of the fastening flange 24 of the lapped member 20, and extends into the nailer 12. As the fastener 46 is tightened, it deforms the fastening flange 24 forcing it to lie flush between the overlying planar panel 18 and the underlying nailer 12 as shown in FIG. 2. The distortion of the fastening flange 24 proximate the fastener 46 causes a resilient distortion of the fastening flange 24 along the length thereof where it is not pressed flat between the overlapping sheet and the nailer 12, and encourages the edge of the fastening flange 24 to tightly fit flush against the underside of the planar panel 18 of the overlapping member 22 immediately above it. This tight seal discourages sawdust particles and the like from entering into the antisiphon gap 54 from the inside of the structure, and also blocks even the passage of reflected light from outside the structure. The fastener 46 is implanted into the nailer 12 with sufficient force to cause the metal washer 48 to compress the rubber or neoprene sealing washer 50 around the shaft of the fastener, thereby preventing leakage around the fastener.

Tightly implanting the fastener 46 creates a downward force in the overlapping member 22 exterior of the fastening point. This downward force is concentrated at the edge of the outer sealing lip 36 which presses down on the interior side wall 26' of the supporting lapped member 20 because the entire overlapping member 22 is spaced above the lapped member 20 so that there are no areas of close mutual contact within the lap joint to distribute the force of the fastener 46. The downward force acts cooperatively with the angle of incidence of the sealing lip 36 upon the interior sloping side wall 26' to cause the outer sealing lip 36 to resiliently deform, sliding slightly down the interior sloping side wall 26' to form a tight even seal where the edge of the outer sealing lip 36 is pressed tightly against the lapped member 20. This slight distortion of the sealing lip 36 acts to compensate for small irregularities in the sealing lip 36 or the interior sloping side wall 26' and provide a tight weatherproof seal at the mouth of the overlap. The strengthening bead 38 provides necessary rigidity to the upper portion 35 of the outer sloping side wall and confines the distortion to the area of the outer sealing lip 36.

The location of the edge of the sealing lip 36 approximately halfway up the interior sloping side wall 26' of the lapped member 20 decreases the likelihood of water entering within the antisiphon gap 54. Draining water would typically run down the sloping side walls of the ribs 14 and be channeled towards the eaves by the troughs formed by the planar panels 18. Since the mouth of the overlap is positioned higher above the plane of the building sheet 10 than the top of the sill 16, blockage of the trough defined by the planar panel 18 would cause the water to spill over the sill 16 onto an adjacent planar panel 18 and not cause the water to back up and enter into the antisiphon gap 54. Water forced up under the sealing lip 42 by wind would be encouraged by gravity to drain back down the interior sloping side wall 26' once the impetus of the wind was removed by the sheltering sealing lip 36. Similarly, dust and similar small solid particles which find their way into the antisiphon gap 54 would be encouraged by gravity to fall out, assisted by the slight relative movement of the outer sealing lip 36 upon the interior sloping side wall 26' of the lapped member 20 caused by thermal expansion and contraction.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A lap joint construction for forming a tight weatherproof juncture between partially overlapping adjacent building sheets for roofing and the like, comprising:

(a) a lapped member including a rib extending along the entire extent of the juncture, said rib including a pair of upwardly-converging sloping sidewalls interconnected by a table;

(b) an overlapping member including an inner section having a shape which is congruent with the shape of a portion of said lapped member, a sealing lip arranged to resiliently separate the entire extent of said overlapping member from said lapped member when said overlapping member is urged toward said lapped member, and an intermediate strengthening bead interfacing said sealing lip with the remainder of said overlapping member; and (c) fastening means for tightly securing said lapped and said overlapping member to an underlying structure and for urging said overlapping member toward said lapped member;

(d) said fastening means being located on the sheet apart from said lapped and overlapping members.

2. A lap joint according to claim 1 wherein said sealing lip contacts one of said sloping side walls of said lapped member intermediate the height thereof when said overlapping member is positioned over said lapped member.

3. The lap joint according to claim 1 including an exterior fastening flange attached to and extending along the outer edge of said rib.

4. A lap joint according to claim 3 wherein said fastening means is placed through the sheet, immediately ajacent to said fastening flange, and tightly secured to an underlying structure.

5. A generally planar building sheet suitable for roofing and siding, said sheet comprising:

(a) a plurality of parallel spaced-apart basic ribs separated from one another by planar panels;

(b) said basic ribs having upwardly-converging side walls interconnected by a table;

(c) a lapped member extending along one margin of this sheet, said lapped member including one of said basic ribs;

(d) an overlapping member extending along the opposite margin of this sheet, said overlapping member including an inner portion of one of said basic ribs and an exterior sealing lip attached to said inner portion of said basic rib along the edge thereof;

(e) an intermediate strengthening bead interconnecting said inner portion of said basic rib and said sealing lip;

(f) said sealing lip situated at a suitable angle for spacing said entire overlapping member above said lapped member of a similar adjacent sheet when said overlapping member is resiliently urged downwardly upon said lapped member.

6. A building sheet according to claim 5 wherein said sealing lip terminates intermediate the height of said lapped member.

7. A building sheet according to claim 5 wherein said inner portion of one of said basic ribs includes the inner one of said upwardly-converging side walls, said table, and the upper portion of the outer one of said upwardly-converging side walls.

8. A building sheet according to claim 5 wherein said sealing lip is situated at an angle 10° nearer to perpendicular to the plane of the sheet than is said sloping side wall of said lapped member.

9. A building sheet according to claim 5 wherein said lapped member includes an exterior fastening flange attached to and extending along the base of said basic rib.

10. A building sheet according to claim 9 wherein said fastening flange is inclined upwardly from the plane of the sheet and extends outwardly from the base of said basic rib.

11. A building sheet of claim 10 wherein said fastening flange is inclined at an angle of 10° from the plane of the sheet.

12. A building sheet according to claim 5 wherein said intermediate strengthening bead comprises a C-shaped ridge integrally attached by its margins to said inner portion and said sealing lip.

* * * * *